US006179111B1

(12) United States Patent
Ratz

(10) Patent No.: US 6,179,111 B1
(45) Date of Patent: Jan. 30, 2001

(54) DEVICE FOR CONVEYING FOLDED SIGNATURES

(75) Inventor: Holger Ratz, Frankenthal (DE)

(73) Assignee: Koenig & Bauer Aktiengesellschaft, Wurzburg (DE)

( * ) Notice: Under 35 U.S.C. 154(b), the term of this patent shall be extended for 0 days.

(21) Appl. No.: 09/269,766

(22) PCT Filed: Oct. 4, 1997

(86) PCT No.: PCT/DE97/02279

§ 371 Date: Apr. 9, 1999

§ 102(e) Date: Apr. 9, 1999

(87) PCT Pub. No.: WO98/16452

PCT Pub. Date: Apr. 23, 1998

(30) Foreign Application Priority Data

Oct. 12, 1996 (DE) ..... 196 42 118

(51) Int. Cl.[7] ..... B65H 29/04
(52) U.S. Cl. ..... 198/370.05; 271/204
(58) Field of Search ..... 198/370.05; 271/204

(56) References Cited

U.S. PATENT DOCUMENTS

| | | | | |
|---|---|---|---|---|
| 3,907,274 | * | 9/1975 | D'Amato et al. | 271/204 |
| 3,924,849 | * | 12/1975 | Murakami | 271/204 |
| 4,039,182 | * | 8/1977 | Reist et al. | 271/204 |
| 4,424,965 | | 1/1984 | Faltin | 271/202 |
| 4,445,681 | * | 5/1984 | Reist | 271/204 |
| 4,470,593 | * | 9/1984 | Halff et al. | 271/204 |
| 5,168,977 | * | 12/1992 | Van Essen et al. | 198/364 |
| 5,172,802 | * | 12/1992 | Wells | 198/470.1 |
| 5,244,078 | * | 9/1993 | Silva et al. | 198/370.05 |
| 5,251,891 | * | 10/1993 | Blaser et al. | 271/204 |
| 5,351,946 | * | 10/1994 | Kamoda et al. | 271/204 |
| 5,415,392 | * | 5/1995 | Maul | 271/277 |

FOREIGN PATENT DOCUMENTS

| | | |
|---|---|---|
| 3221001 | 6/1982 | (DE) . |
| 0 561 755 | 9/1993 | (EP) . |
| WO 96/06032 | 2/1996 | (WO) . |

* cited by examiner

*Primary Examiner*—Thomas J. Brahan
(74) *Attorney, Agent, or Firm*—Jones, Tullar & Cooper, PC

(57) ABSTRACT

Folded signatures are delivered to a paddle wheel and then are transported to a plurality of distribution points by a gripper chain with a plurality of grippers. A controllable switching unit is provided at each distribution point in the form of a rotatable cam disk with switching cams. The rotatable cam disk at each distribution point is caused to rotate by an individual motor at a controlled speed and time. The speed of rotation of each cam disk can be greater than the speed of travel of the gripper chain so that the point of release of each signature can be accurately controlled.

8 Claims, 3 Drawing Sheets

"X"
"Y"
"Z"
A
B
C
D
E
H
1
2
3
6
7
9
11
12
13
14
16
24
26
27
28
29
30
31
32
33
34
35
36
37
38
42

DEVICE FOR CONVEYING FOLDED SIGNATURES

FIELD OF THE INVENTION

The present invention relates to a device for transporting folded signatures which are held by controllable grippers. The folded signatures are transported and distributed to a pluarlity of distribution points.

DESCRIPTION OF THE PRIOR ART

A art device is known from WO 96/06032. A ratchet wheel having several control cams is provided for controlling the grippers which are holding signatures. The circumferential speed of the ratchet wheel with the control cams is synchronized with the conveying speed of the gripper chain. The control cams each come slowly into contact from above with the control roller which is assigned to them and slowly push it into an "open position". An exact delivery of the signatures is not possible in this way, so that the spacing between the scaled or layered signatures becomes irregular. This leads to interruptions of downstream-connected processing machines.

The object of the invention is based on creating a device for transporting and distributing folded signatures removed from a paddle wheel by means of a gripper chain.

In accordance with the invention, this object is attained by providing rotatable control devices which are exactly positioned to open the signature grippers at a desired location. The rotatable control devices have several control cams and can be moved between non-switching and switching positions. The speed of rotation of the control devices can be temporarily greater than the conveying speed of the gripper chain.

The advantages which can be achieved by means of the present invention reside in particular in that a gripper chain which has a simple structure is employed. Short switching times become possible, so that a respectively different distribution point can be provided for each folded signature even at high speeds of the gripper chain. For actuating the gripper mechanism, discontinuously drivable cam disks with several control cams are employed in an advantageous manner, which cam disks are controlled or regulated at exact angles of rotation. The control cams of a cam disk are moved into the movement path of the control roller of the gripper system and are stopped before the control roller reaches the switch location. Thus, the switching process takes place with the cam disk at a standstill. Therefore a "creeping" actuating process is avoided. The path of the gripper chain on its way to the several distribution stations can be kept straight or only slightly curved.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figures 1, 4:
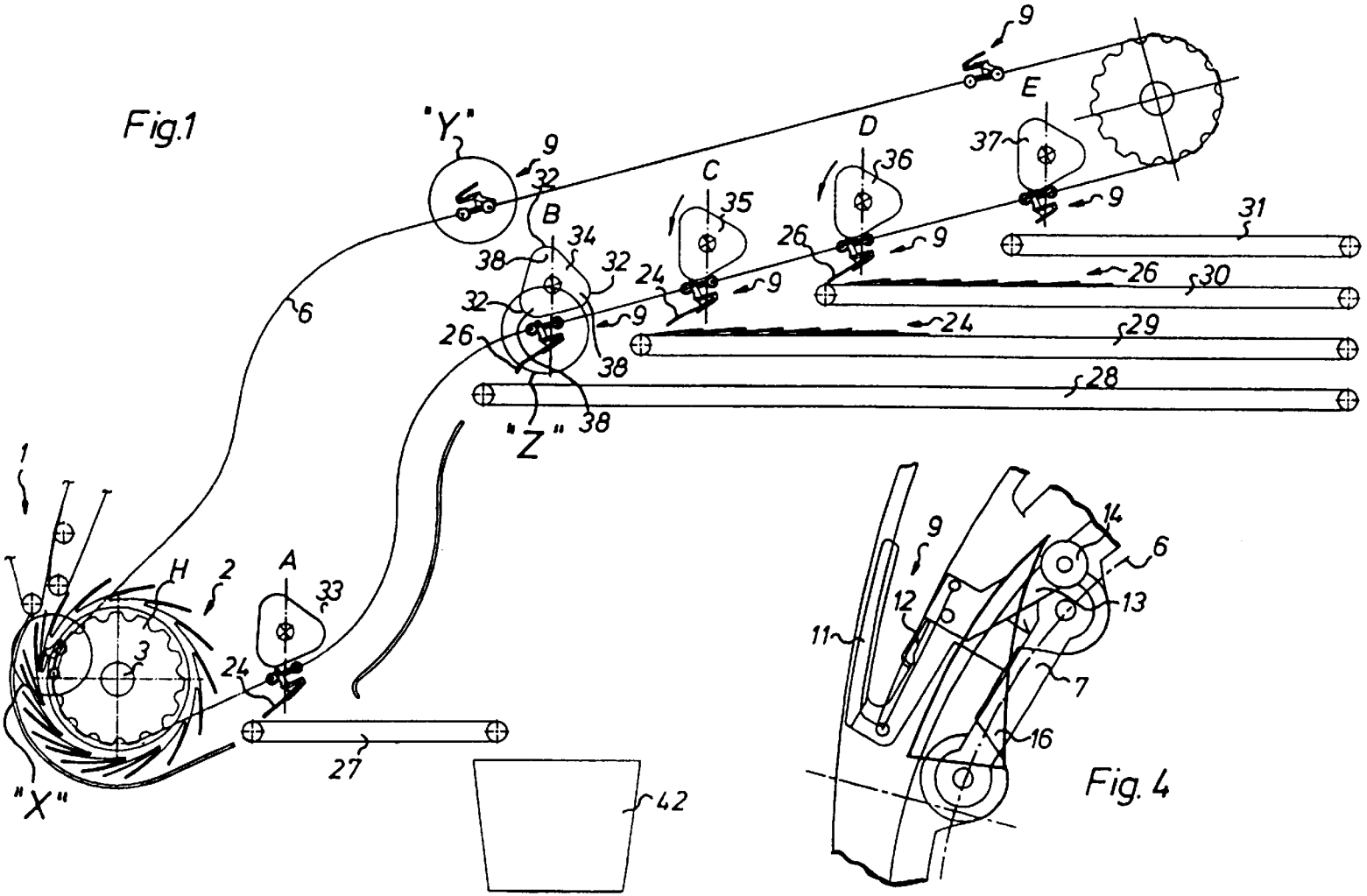
FIG. 1, a schematic representation of a lateral view of the distribution device.
FIG. 4, a detail "X" from FIG. 1 with an enlarged representation of a control cam, fixed in place on the frame, for closing the pivotable clamping jaw; and in FIG. 5, a basic wiring diagram for driving the device in accordance with FIG. 1.

A known paddle wheel 2 is arranged underneath a belt system 1 coming from a folding device. The paddle wheel 2 can consist, for example, of four individual paddle wheels, fastened spaced apart from each other on a shaft 3. A chain wheel 4 is also fastened on the shaft 3 and is arranged between the second and the third paddle wheel. On its circumference, the chain wheel 4 has, for example, fifteen teeth, and guides a gripper chain 6. Spaces between the teeth of the chain wheel 4 are in interlocking connection with rollers 8 located on each chain link 7 as seen in FIGS 2–4.

Figure 2:
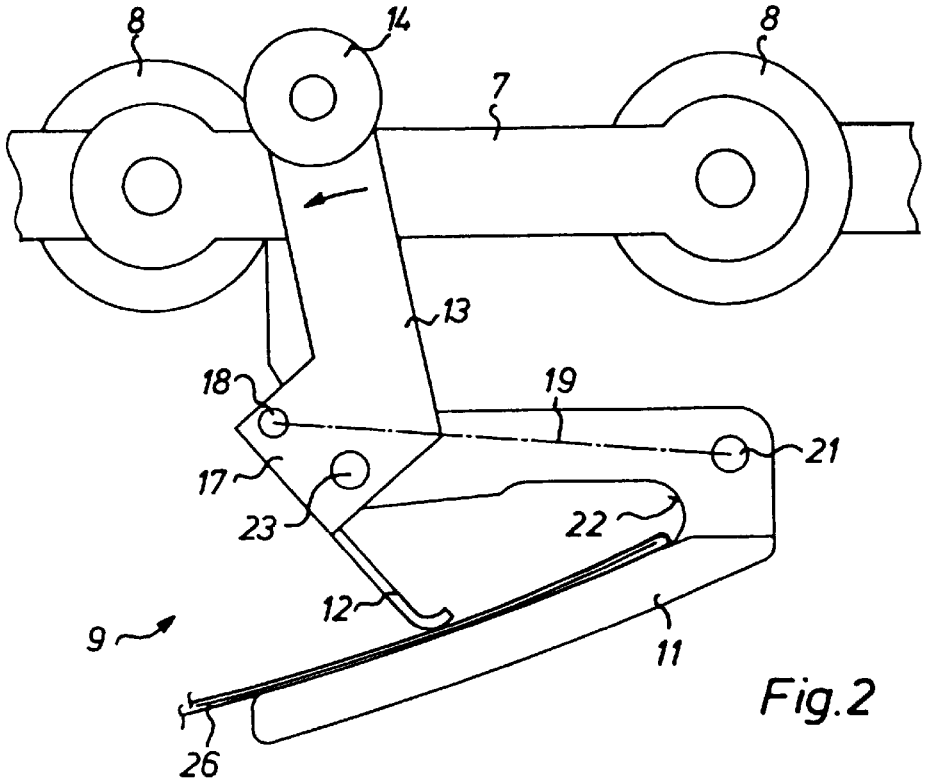
FIG. 2, a detail "Z" from FIG. 1 with an enlarged representation of a closed gripper.
Figure 3:
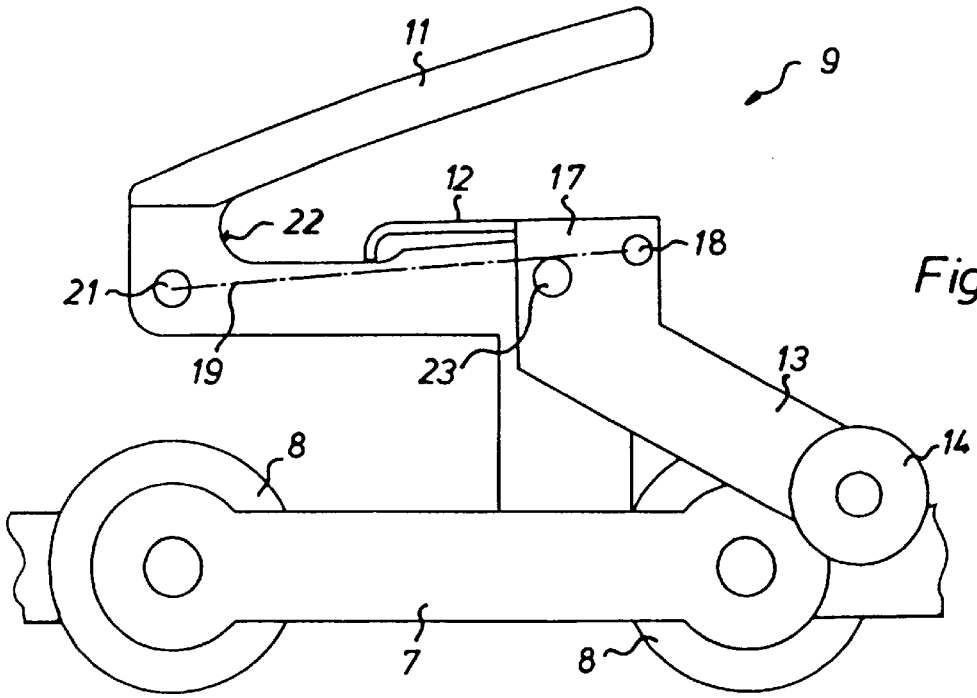
FIG. 3, a detail "Y" from FIG. 1 with an enlarged representation of an open gripper.

Each chain link 7 supports a gripper 9, which consists of a fixed clamping jaw 11, and a pivotable clamping jaw 12, as seen most clearly in FIGS. 2 and 3. As shown in the lateral views of FIGS. 1–3, the fixed clamping jaw 11 is essentially designed in a V-shape and is fixedly connected with the chain link 7. The pivotable clamping jaw 12 is designed as a first arm of a three-armed lever arm. A second lever arm of the three-armed lever is designed as a control lever 13 and supports a roller 14 at its free end. The control lever 13 can be actuated by having roller 14 ride on a control cam 16, which, as seen in FIG. 4, is fixed on the frame and is located in the vicinity of the paddle wheel 2 and is used, for closing the pivotable clamping jaw 12. The control lever 13 can also be actuated by having roller 14 ride on a cam disk 33 to 37, which has yet to be described, for opening the pivotable clamping jaw 12. A third lever arm of the three-armed lever is designed as a spring-tension lever 17, which has the point of the application 18 of a force for a prestressed tension spring 19. An abutment 21 or end for the tension spring 19 is located in the vicinity of the socket bottom 22 of the V-shaped fixed clamping jaw 11.

All lever arms 12, 13, 17 of the three-armed lever arm have a pivot point 23 in their base. This pivot point 23 is connected with a bearing, which is located at the end close to the chain of one of the legs of the V-shaped fixed clamping jaw 11.

The levers 13, 17 can also be arranged on both sides of each chain link 7. Two spaced tension springs 19 and two rollers 14, one on each side of each chain link 7 are then provided.

The lower belt of the endless gripper chain 6 consisting of the chain links 7 with the respective grippers 9 fixedly arranged thereon is passed in accordance with the technical production requirements past several distribution points A, B, C, D, E for distributing folded signatures 24, 26 received by the gripper chain 6 from the paddle wheel 2, as shown in FIG. 1.

The path of movement of the gripper chain 6 in the area of the distribution points A, B, C, D, E is preferably straight. At most, the path of chain 6 is slightly curved.

Such distribution points can be, for example: A, a shunt for waste, B, a removal point for test sheets, as well as C, D, E, deposit points for folded signatures 24, 26.

A belt system 27 to 31 for receiving the deposited signatures 24, 26 is provided under each distribution point A to E.

Figure 5:
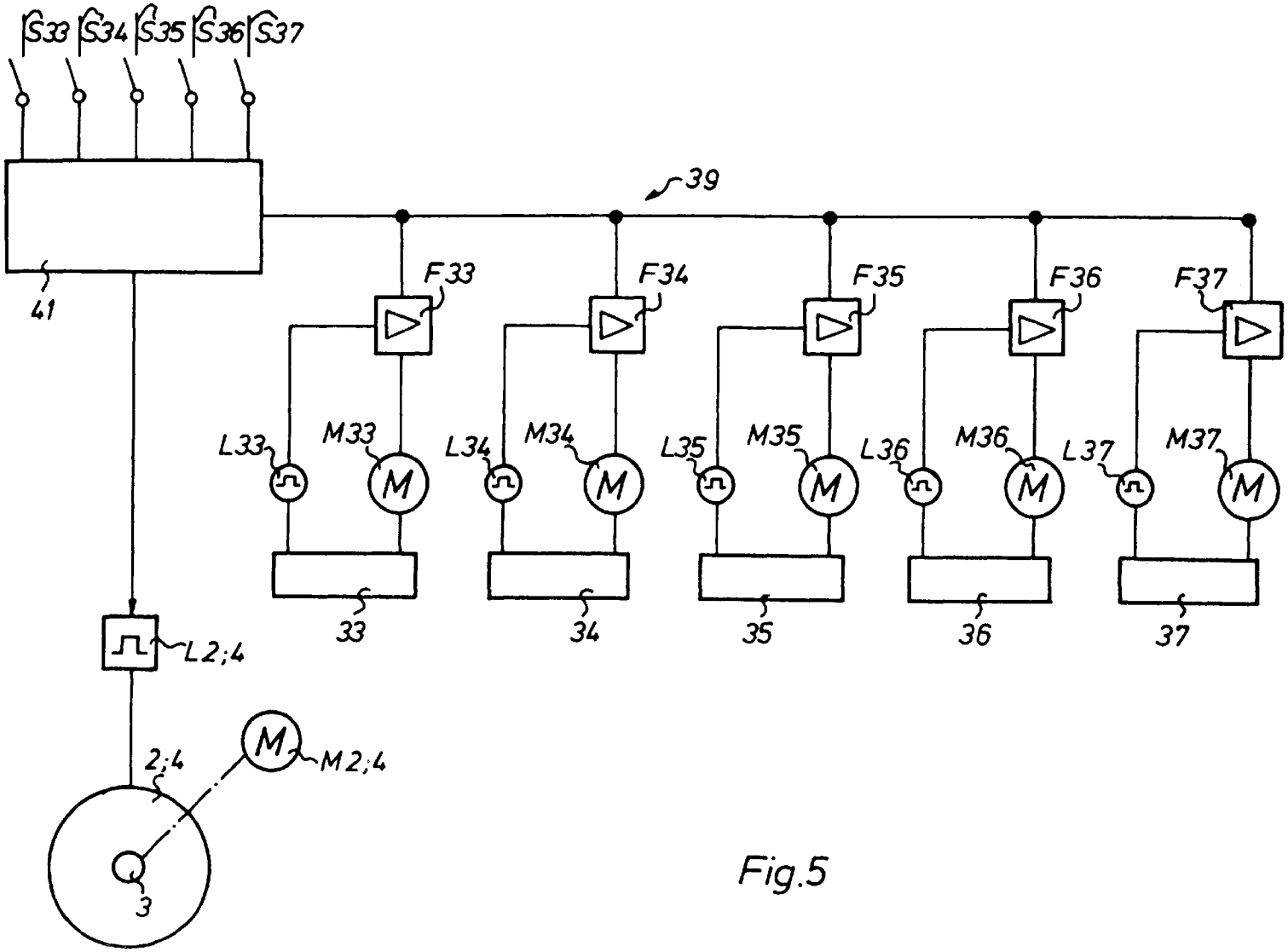

A controllable switching unit, for example a cam disk 33 to 37, is arranged at each distribution point A to E, as seen in FIG. 1. Each cam disk 33–37 has several—for example three—control cams 38 evenly distributed over its circumference. Each cam disk 33 to 37 is connected, fixed against relative rotation, with a motor, whose angular rotational position is regulated, for example by a servo motor M33 to M37, as seen in FIG. 5. A rotor of a position sensor L33 to L37, fixed on the frame, is connected, fixed against relative rotation, with each cam disk 33 to 37, as seen in FIG. 5. Each position sensor L33 to L37 is an angle of rotation position sensor and is, for example designed as a rotary pulse sensor with a reference marker, and is arranged, for example, interlockingly, on its respective cam disk 33 to 37. The motors M33 to M37, as well as the position sensors L33 to L37 of each cam disk 33 to 37 are electrically connected with an actuation regulator F33 to F37 with integrated position detection. For the purpose of a data exchange, all actuation regulators F33 to F37 are connected via a data bus 39 with a computer unit 41, all as is shown in FIG. 5. The computer unit 41 is also electrically connected with switches S33 to S37 for the preselectable actuation of one or several distribution points A to E.

The shaft 3 of the paddle wheel 2, or respectively of the chain wheel 4 is connected mechanically, for example with a drive motor M2, 4, as well as with a position and rpm sensor L2, 4, and thereafter with the computer unit 41. This assembly is also schematically depicted in FIG 5.

The shaft 3 of the paddle wheel 2, or respectively of the chain wheel 4 can also be driven by means of a drive wheel train coming from the folding device. Unless represented differently, all of the above described devices are seated fixed in the lateral frame.

The operation of the device for transporting folded signature, in accordance with the present invention, is described in what follows. The signatures 24, 26—which, for example are different—and are coming from the folding device via the belt system 1, each continuously fall into their one paddle pocket of the paddle wheel 2. The gripper chain 6, which simultaneously circulates in the phase of the paddle wheel 2, picks up every one of the sequentially arriving signatures 24, 26. Following the roll-off of the respective rollers 14 of the control levers 13 on the control cam 16 fixed on the lateral frame, each signature 24, 26 is clamped in its associated one of the grippers 9 by the interaction between the pivotable clamping jaw 12 and the fixed clamping jaw 11. In the course of this pivot movement of each of the three-armed control levers 13 (in a clockwise rotating direction as seen in FIG. 3), the tension spring 19 is pivoted from its stable open position through an extended spring dead center position into a stable closed position which is shown in FIG. 2. When the spring 19 is in the dead center position, the abutment 21, the pivot point 23, as well as the point of the application of a force 18 are located on an imagined straight line. However, in the open position or the closed position the tension spring 19 is in a more relaxed stable position compared with the dead center position. Switching from one to the other position takes place with only a slight exertion of force and within a period of time of a few milliseconds.

If the signatures 24, 26 are to be deposited in the distribution points C and D, for example, the associated switches, for example the switches S35 and S36, are activated. The rotation of the motors M35, M36 over a rotationally accurate angle, and therefore an associated rotation of the cam disks 35 and 36, is triggered by this actuation of switches S35 and S36. The cam disks 33, 34 at the distribution points where no actual distribution takes place at that time, for example A, B, are then in a "non-control position", in which the cam disks 33, 34 are in such a position that their cams 38 are outside of the movement path of the rollers 14 of the control levers 13 as seen in FIG. 2. The switching—and non-switching—control faces can be straight and/or curved. In the present case the non-switching control face is not curved as shown in FIG. 1.

For practical as well as for safety reasons, the cam disks 37 of the last distribution point E are always in the "signature off" position to assure that all signatures 24, 26 are removed on the last belt system 31 at the latest. In place of the cam disk 37, it is also possible to provide a stationary control cam for opening each pivotable clamping jaw 12, provided that opening has not already taken place previously. The roller 14 of a gripper 9 carrying a signature 24 enters the area of a non-switching section of the cam disk 35. The cam disk rotates in a counterclockwise direction as shown in FIG. 1, so that a cam 38 comes into operational connection with the roller 14 of the control lever 13. In the process, the lever 13 is pivoted in a counterclockwise direction as shown in FIG. 2, so the signature 24 is deposited on the belt system 29. The same process is repeated at the cam disk 36 with a following signature 26. There, the signatures 26 are deposited on the belt system 30.

Preferably the rotation of each of the cam disks 35, or respectively 36, for opening the corresponding gripper 9 takes place discontinuously over an angle of rotation of respectively 120°. In the course of this, the cam disks 35, 36 act together in the above described manner with the motors M35, M36, the position sensors L35, L36, the actuation regulators F35, F36 and the computing unit 41. The motors M35, M36 are preferably designed as step motors.

It is also possible to move all signatures via the belt system 27 to a waste container 42, or to also include the distribution points B and E, not used so far. If all signatures 24, 26 are to be temporarily moved to the waste container 42, it would be possible to employ a control cam, which can be pivoted into a "signature off" position by means of a work cylinder, in place of a cam disk 33.

In summary, the essence of the invention lies in that a rotatable control device or cam disc 33 to 37 is provided, which has control cams which are controlled or regulated at exact positions of the angles of rotation, wherein the control cams are arranged in a switching or non-switching position on cam disks 33 to 37.

The circumferential speed of the highest points 32 of the control cams 38 in the course of their movement from a non-switching movement into a switching position is greater, or at least temporarily greater than the conveying speed of the gripper chain 6.

The direction of rotation of the cam disks 33 to 37 can always be either in the conveying direction or counter to the conveying direction of the gripper chain 6. If switching times are not important, they can also be continuously back and forth.

In an advantageous manner, each pivotable clamping jaw 12 can be selectively individually actuated, i.e. for example, at a defined location so that only it and no other clamping jaw is actuated at a desired time at a particular location.

While a preferred embodiment of a device for transporting folded signatures in accordance with the present invention has been set forth fully and completely hereinabove, it will be apparent to one of skill in the art that a number of changes in, for example, the type of printing press being used to print the signatures, the type of folding device used to fold the signatures and the like may be made without departing from the true spirit and scope of the present invention which is accordingly to be limited only by the following claims.

What is claimed is:

1. A device for transporting and distributing signatures comprising:

an endless gripper chain;

a plurality of controllable signature grippers on said endless gripper chain each of said controllable signature gripper shaving a control roller each said control roller being movable between a gripper opening position and a gripper closing position;

a plurality of separate signature receiving distribution points spaced along a movement path of said endless gripper chain;

a rotatable control device associated with each one of said plurality of separate signature distribution points, each said rotatable control device having a plurality of control cams each said control cam being movable between a control position and a non-control position by rotation of each said control device, one of said plurality of control cams on each said rotatable control device engaging one of said control rollers of one of said controllable signature grippers in said control position and being out of engagement with said control rollers in said non-control position; and means for rotating each of said rotatable control devices so that a circumferential speed of movement of a highest point of each said control cam is at least temporarily greater than a conveying speed of said endless gripper chain during distribution of a signature to a selected one of said plurality of signature receiving distribution points, and further so that each said control cam is selectively stopped in one of said control and non-control positions when each said control roller passes each said associated signature receiving distribution point.

2. The device for transporting and distributing signatures in accordance with claim 1 wherein a direction of rotation of each of said rotatable control devices is in the direction of travel of said endless gripper chain.

3. The device for transporting and distributing signatures in accordance with claim 1 wherein a direction of rotation of each of said rotatable control devices is opposite to the direction of travel of said endless gripper chain.

4. The device for transporting and distributing signatures in accordance with claim 1 wherein each of said plurality of controllable signature grippers can be opened at a desired one of said plurality of signature receiving distribution points.

5. The device for transporting and distributing signatures in accordance with claim 1 further including a motor for rotating each one of said rotatable control devices, and a computer control unit for said motors.

6. The device for transporting and distributing signatures in accordance with claim 5 wherein each said motor is an angle of rotation positionally controlled motor.

7. The device for transporting and distributing signatures in accordance with claim 6 further including an angle of rotation position sensor associated with each said motor.

8. The device for transporting and distributing signatures in accordance with claim 7 further including an actuation regulator associated with each said position sensor and each said motor.

* * * * *